US007690507B2

(12) United States Patent
Sutherland

(10) Patent No.: US 7,690,507 B2
(45) Date of Patent: Apr. 6, 2010

(54) PACKAGE FOR CONTAINERS

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 592 days.

(21) Appl. No.: 11/544,254

(22) Filed: Oct. 6, 2006

(65) Prior Publication Data

US 2007/0080084 A1 Apr. 12, 2007

Related U.S. Application Data

(60) Provisional application No. 60/724,406, filed on Oct. 7, 2005.

(51) Int. Cl.
*B65D 71/18* (2006.01)

(52) U.S. Cl. ..... 206/427; 206/148; 206/429

(58) Field of Classification Search ..... 206/427, 206/429, 434, 145, 139, 147, 148, 149, 152, 206/155, 156, 157, 158, 167, 168, 175; 229/934
See application file for complete search history.

(56) References Cited

U.S. PATENT DOCUMENTS

| | | | | |
|---|---|---|---|---|
| 2,737,326 | A | 3/1956 | Toensmeier | |
| 2,764,284 | A | 9/1956 | Arneson | |
| 2,950,041 | A | 8/1960 | Stone | |
| 3,245,711 | A | 4/1966 | Dantoin | |
| 3,722,945 | A | 3/1973 | Wood | |
| 3,767,041 | A | 10/1973 | Graser | |
| 4,131,198 | A * | 12/1978 | Fischer | 206/419 |
| 4,188,766 | A | 2/1980 | Culpepper | |
| 4,192,540 | A | 3/1980 | Oliff | |
| 4,326,628 | A | 4/1982 | Wood | |
| 4,336,898 | A | 6/1982 | Joyce | |
| 4,432,579 | A | 2/1984 | Denmark et al. | |
| 4,438,843 | A | 3/1984 | Graser | |
| 4,489,880 | A * | 12/1984 | Calvert | 206/434 |
| 4,566,591 | A | 1/1986 | Turtschan et al. | |
| 4,703,847 | A * | 11/1987 | Oliff | 206/434 |
| 5,135,104 | A | 8/1992 | Jorba | |
| 5,188,225 | A | 2/1993 | Jorba | |
| 5,351,815 | A | 10/1994 | Fogle et al. | |
| 5,598,920 | A | 2/1997 | Hansen | |
| 5,638,956 | A | 6/1997 | Sutherland | |
| 5,687,838 | A | 11/1997 | Bakx | |
| 5,984,086 | A | 11/1999 | Foushee et al. | |
| 6,223,892 | B1 | 5/2001 | Bakx | |
| 6,488,322 | B2 | 12/2002 | Bakx | |
| 6,615,984 | B2 | 9/2003 | Saulas et al. | |
| 7,264,114 | B2 | 9/2007 | Daniel | |
| 2002/0113449 | A1 | 8/2002 | Bakx | |

(Continued)

FOREIGN PATENT DOCUMENTS

| | | |
|---|---|---|
| DE | 203 17 334 U1 | 2/2004 |

(Continued)

*Primary Examiner*—Ehud Gartenberg
*Assistant Examiner*—Andrew Perreault
(74) *Attorney, Agent, or Firm*—Womble Carlyle Sandridge & Rice, PLLC

(57) ABSTRACT

A package is formed from a carton and containers extending through a bottom panel of the carton. Engaged upper and lower strut pairs and brace apertures in the carton sidewalls provide support for the containers accommodated within the carton.

22 Claims, 6 Drawing Sheets

U.S. PATENT DOCUMENTS

| | | | |
|---|---|---|---|
| 2004/0079666 | A1 | 4/2004 | Bakx |
| 2004/0226833 | A1 | 11/2004 | Daniel |

FOREIGN PATENT DOCUMENTS

| | | | |
|---|---|---|---|
| DE | 20 2004 004 248 | U1 | 8/2004 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 541 334 | A1 | 5/1993 |
| EP | 0 780 320 | A1 | 6/1997 |
| EP | 1 070 671 | A1 | 1/2001 |
| EP | 1 384 679 | A1 | 1/2004 |
| FR | 1 582 235 | | 9/1969 |
| FR | 2 525 992 | | 11/1983 |
| FR | 2 664 239 | | 1/1992 |
| FR | 2 731 413 | | 9/1996 |
| GB | 1 342 180 | | 12/1973 |
| GB | 2 158 037 | A | 11/1985 |
| WO | WO 97/33807 | | 9/1997 |
| WO | WO 98/49071 | | 11/1998 |
| WO | WO 99/01356 | | 1/1999 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2005/095222 | A1 | 10/2005 |

* cited by examiner

PACKAGE FOR CONTAINERS

PRIORITY APPLICATION

This application claims the benefit of U.S. Provisional Application No. 60/724,406, filed Oct. 7, 2005, the entire contents of which are hereby incorporated by reference.

RELATED APPLICATIONS

This application is related to U.S. Provisional Application Nos. 60/763,654, filed Jan. 31, 2006, 60/759,319, filed Jan. 17, 2006, and 60/763,425, filed Jan. 30, 2006. This application is related to U.S. application Ser. No. 11/475,764, filed Jun. 27, 2006.

BACKGROUND

1. Technical Field

The technical field relates to cartons for accommodating containers and packages formed therefrom.

2. Related Art

Cartons for engaging and securing upper portions of containers are known. The containers are typically inserted through apertures in a bottom panel of the carton and secured by engaging radially protruding parts of the containers. One such carton is disclosed in U.S. Pat. No. 6,223,892 to Bakx. Conventional cartons, however, may not securely retain the containers, or may fail to satisfy other requirements recognized in the art.

SUMMARY

According to a first aspect of the invention, a package comprises a carton with a plurality of containers accommodated therein. The carton comprises a top panel, a bottom panel, a first side panel, a second side panel, a plurality of upper struts extending from the bottom panel along a first row, each upper strut comprising an upper strut first section and an upper strut second section, and a plurality of lower struts extending from the bottom panel along a second row, each lower strut comprising a lower strut first section and a lower strut second section. The containers are received within a first row of container apertures arranged adjacent to the row of upper strut sections, and a second row of container apertures arranged adjacent to the row of lower strut sections. Each upper strut first section contacts the underside of a flange of a container in the first row and the underside of the flange of an adjacent container in the second row. Each lower strut first section may, for example, be out of contact with the flanges and secured by a tab.

According to a second aspect of the invention, the side panels of the carton can include brace apertures through which portions of the container flanges extend. The brace apertures have lower brace edges that support the undersides of the container flanges. During erection of the carton, the carton blank can be tightly wrapped around the upper portions of the containers to retain the containers within the carton.

According to the above aspects of the invention and additional aspects described below, the brace apertures and the engaged upper and lower struts serve to prevent the containers from inadvertently being pulled downward through the container apertures, and also prevent excessive movement or pivoting of the containers accommodated within the carton.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to cartons for attachment to containers. The cartons engage and secure upper portions of the containers to form a package.

Figure 1:
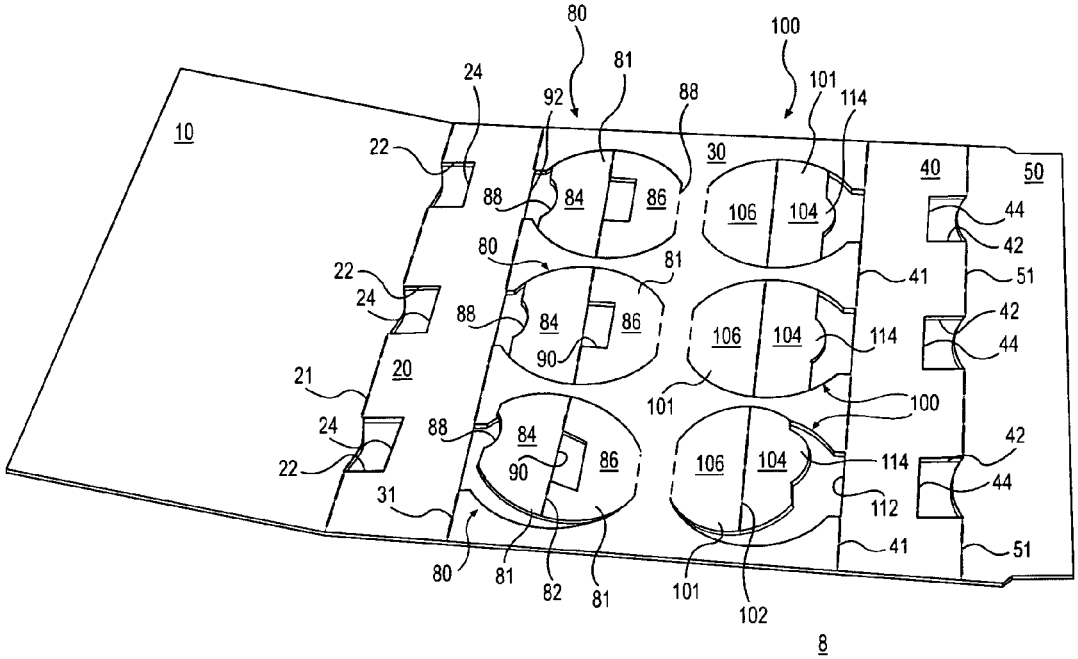
FIG. 1 is a perspective view of a blank used to form a package according to a first embodiment of the invention.

FIG. 1 is a plan view of a blank 8 used to form a carton or carrier 150. The carton or carrier 150 is illustrated in its erected state in FIG. 6, in which it is attached to upper portions of containers 170, forming a package 200. Referring to FIG. 1, the blank 8 comprises a top panel 10 foldably connected to a first side panel 20 at a first transverse fold line 21, a bottom panel 30 foldably connected to the first side panel 20 at a second transverse fold line 31, a second side panel 40 foldably connected to the bottom panel 30 at a third transverse fold line 41, and an adhesive panel 50 foldably connected to the second side panel 40 at a fourth transverse fold line 51.

The transverse fold lines 21, 31, 41, 51 in the blank 8 can be more generally referred to as lines of weakness or disruption in the blank about which the blank is foldable. Each of the fold lines 21, 31, 41, 51 may be interrupted at one or more locations, for example, and need not be continuous across the transverse direction of the blank 8. One or more cuts may be, for example, placed along each of the transverse fold lines 21, 31, 41, 51. In the exemplary embodiment illustrated in FIG. 1, the transverse fold lines 21, 31, 41, 51 are cut/crease lines in which the cuts facilitate folding of the blank 8 at the fold lines. Any number of cuts may be formed along the fold lines 21, 31, 41, 51, and the number and length of the cuts may be selected according to, for example, the gauge and the stiffness of the material used to form the blank 8. The cuts may be partial cuts (e.g. kiss cuts), or 100% cuts extending through the entire thickness of the blank 8.

The bottom panel 30 includes a plurality of first container-receiving patterns 80 and a plurality of second container-receiving patterns 100. The first container-receiving patterns 80 are arranged in a first row, and the second container-receiving patterns 100 are arranged in a second row. Each container-receiving pattern 80, 100 is shaped and sized to receive an upper portion of a container 170 that is to be held within the carton 150. In the exemplary embodiment, three columns of patterns 80, 100 are formed in the bottom panel 30 so that six containers 170 can be accommodated in the erected carton 150, forming a 2×3 package. Other package configurations, such as 2×2, 2×4 or 2×5, etc. are also within the scope of the present invention.

Each first container-receiving pattern 80 defines an upper strut 81, and each second container-receiving pattern 100 defines a lower strut 101. Each upper strut 81 is engageable with an adjacent lower strut 101 in the finished carton 150. Each upper strut 81 includes an upper strut first section 84 and an upper strut second section 86 foldably connected to the upper strut first section 84 at a transverse fold line 82. The upper strut first sections 84 have concave curved distal edges 88 which may be shaped and dimensioned to engage the upper portion of a container 170. Each lower strut 101 includes a lower strut first section 104 and a lower strut second section 106 foldably connected to the lower strut first section 104 at a transverse fold line 102. The upper struts 81 include tab-receiving apertures 90, and the lower struts 101 include tabs 114 extending from distal ends of the lower strut first sections 104. The tabs 114 are sized to be received within the tab-receiving apertures 90 in the erected carton 150.

Figure 2:
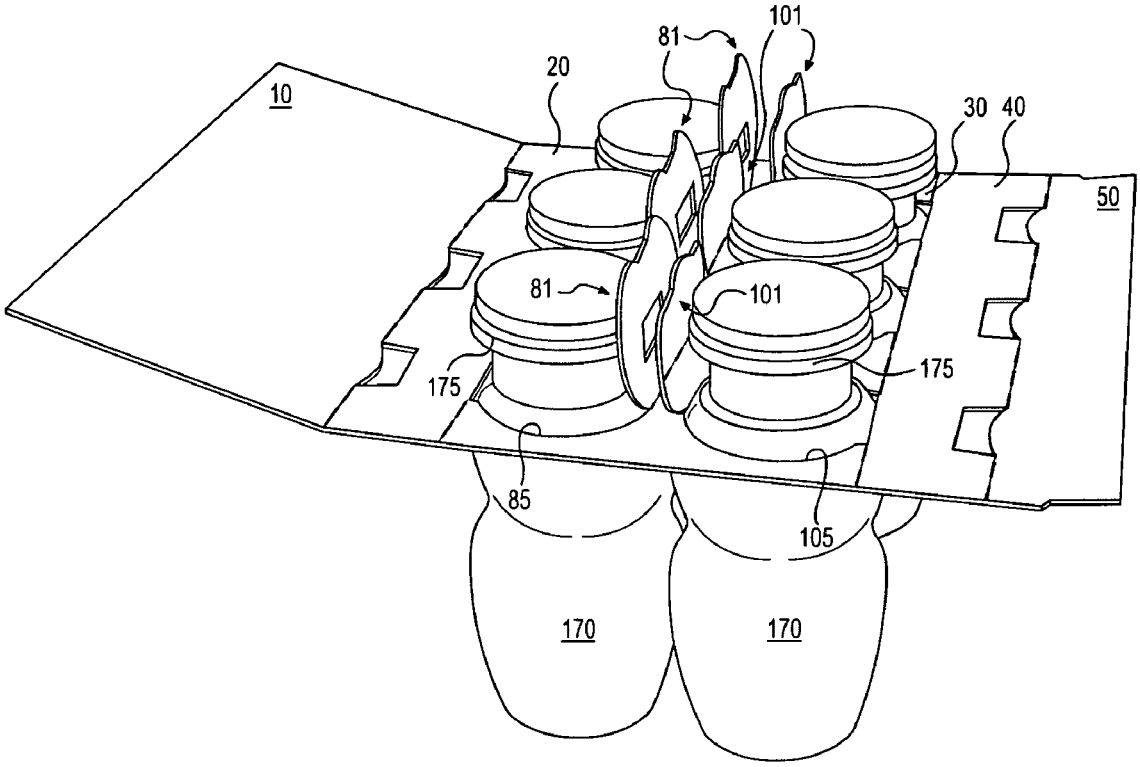
FIG. 2 illustrates an erection step for forming the first package embodiment.

The first side panel 20 includes first brace apertures 22. The number of first brace apertures 22 may correspond to the number of columns of container-receiving patterns 80, 100. Referring also to FIG. 2, each brace aperture 22 is adapted to receive an upper flange portion 175 of a container 170 held within an adjacent first container aperture 85 formed from a corresponding first container-receiving pattern 80. The first brace apertures 22 have lower, brace edges 24 located at or adjacent to the first transverse fold line 21 and cut from the first side panel 20. The second side panel 40 includes second brace apertures 42 adapted to receive upper flange portions 175 of containers 170 received within second container apertures 105 formed from the second container-receiving patterns 100. The number of second brace apertures 42 may also correspond to the number of columns of container-receiving patterns 80, 100. The second brace apertures 42 have lower, brace edges 44 cut from the second side panel 40. The patterns 80, 100 and the apertures 22, 42 are arranged in three columns in FIG. 1. From left to right, each column includes an aligned aperture 22, a pattern 80, a pattern 100, and an aperture 42.

An exemplary method of erection of the carton 150 to form the package 200 is discussed below with reference to FIGS. 2-6.

FIG. 2 is a perspective view of an erection step of the carton 150 and its initial attachment to the containers 170. Top portions of the containers 170, including their flanges 175, are inserted through the first and second container-receiving patterns 80, 100. Inserting the containers 170 may serve to open up the first and second container apertures 85, 105 at the first and second container-receiving patterns 80, 100, respectively. The container apertures 85, 105 may, for example, have curved or arcuate sidewalls at each end that may generally conform in shape to the exteriors of the containers 170. In FIG. 2, the upper and lower struts 81, 101 extend generally upwardly from the bottom panel 30.

Figure 3:
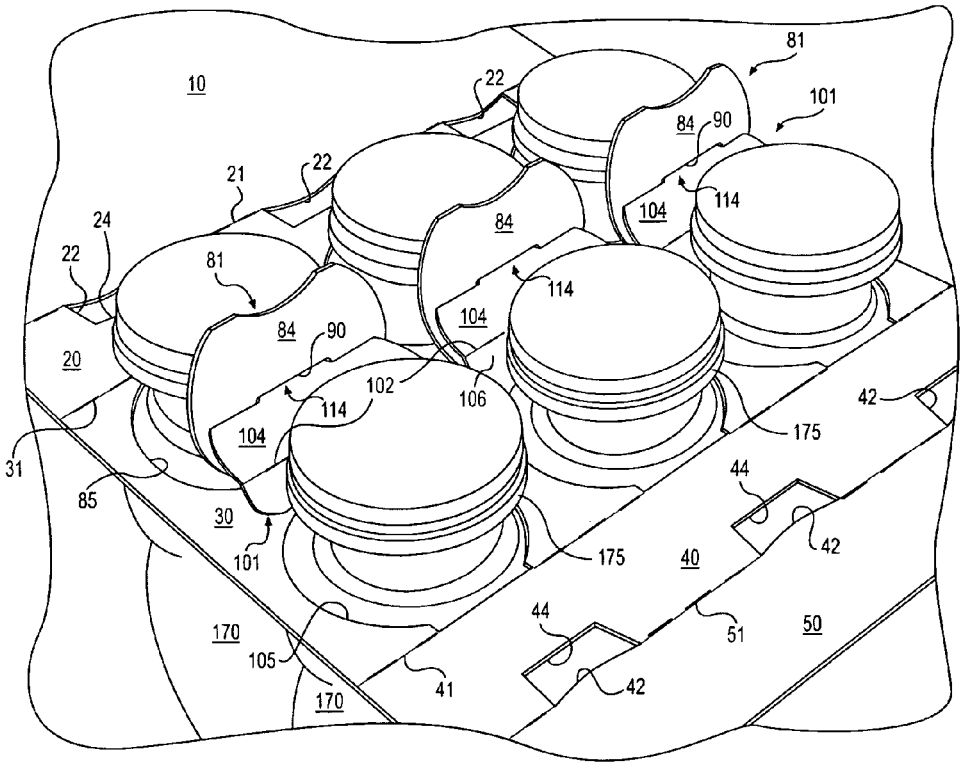
FIG. 3 illustrates an erection step for forming the first package embodiment.

Referring to FIG. 3, the lower struts 101 are folded at the fold lines 102 so that the tabs 114 extending from the distal ends of the lower strut first sections 104 extend into the tab-receiving apertures 90 in the upper struts 81. The lower strut first sections 104 now extend generally parallel to the bottom panel 30. The lower strut second sections 106 may deform to some degree as the lower strut first sections 104 are folded and engaged with the tab-receiving apertures 90, but otherwise extend generally upright.

Figure 4:
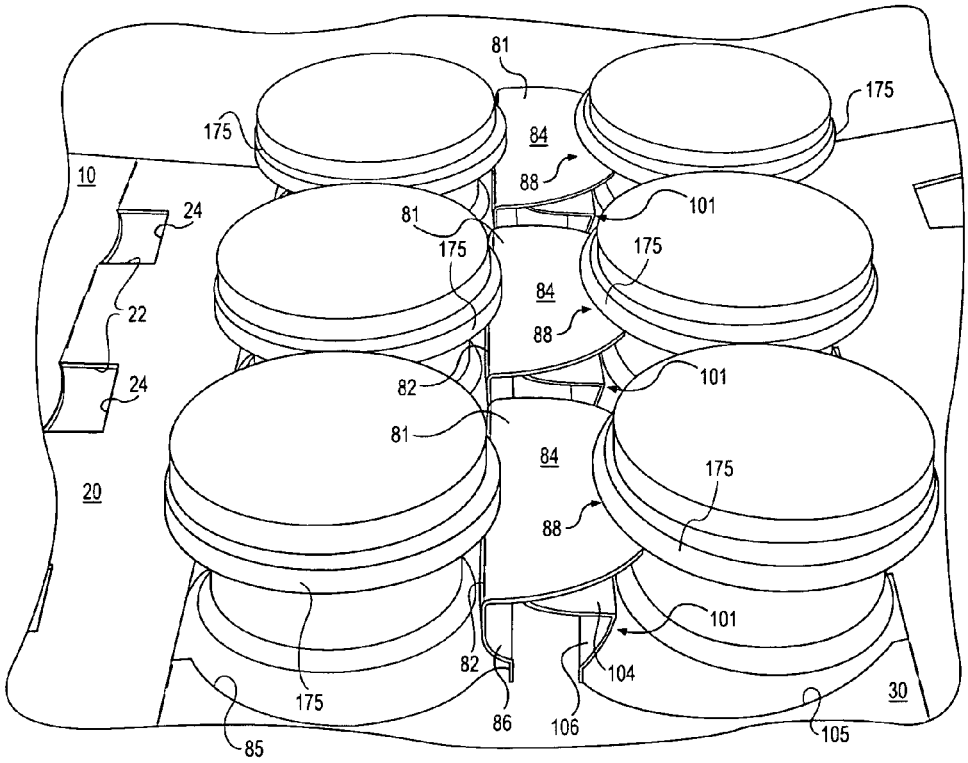
FIG. 4 illustrates an erection step for forming the first package embodiment.

Referring to FIG. 4, the first sections 84 of the upper struts 81 are folded over at the fold lines 82. The upper strut first sections 84 now extend generally parallel to the bottom panel 30. The upper strut second sections 86 may deform to some degree as the upper strut first sections 84 are folded and engaged with the flanges 175, but otherwise extend generally upright. The portions of the upper strut first sections 84 adjacent to the fold lines 82 may each engage the underside of a flange 175 of a container 170 disposed in the first row of container apertures 85. The curved distal edge 88 at the opposite end of each upper strut first section 84 engages the undersides of a container flange 175 of an adjacent container 170 disposed in the second row of container apertures 105. The tabs 114 (shown in FIG. 3) extending through the tab-receiving apertures 90 in the upper struts 81 secure the lower strut first sections 104 in position. The lower strut first sections 104 and/or the lower strut second sections 106 may remain out of contact with the container flanges 175.

Figure 5:
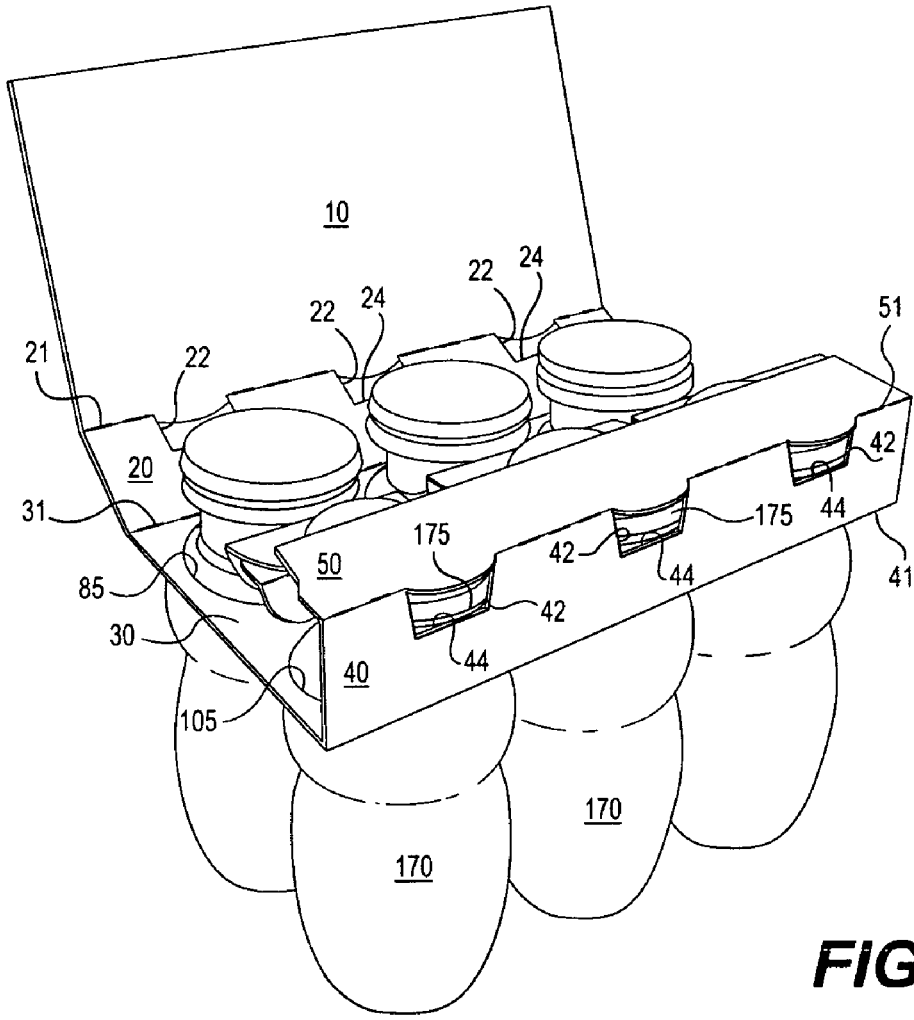
FIG. 5 illustrates an erection step for forming the first package embodiment.

Referring to FIG. 5, the adhesive panel 50 is folded about the transverse fold line 51 so that it extends over the tops of the containers 170 disposed within the second row of container apertures 105. The top panel 10 may then be folded about the transverse fold line 21 so that the underside of the top panel 10 can be adhered or otherwise secured to the adhesive panel 50, as shown in FIG. 6.

Figure 6:
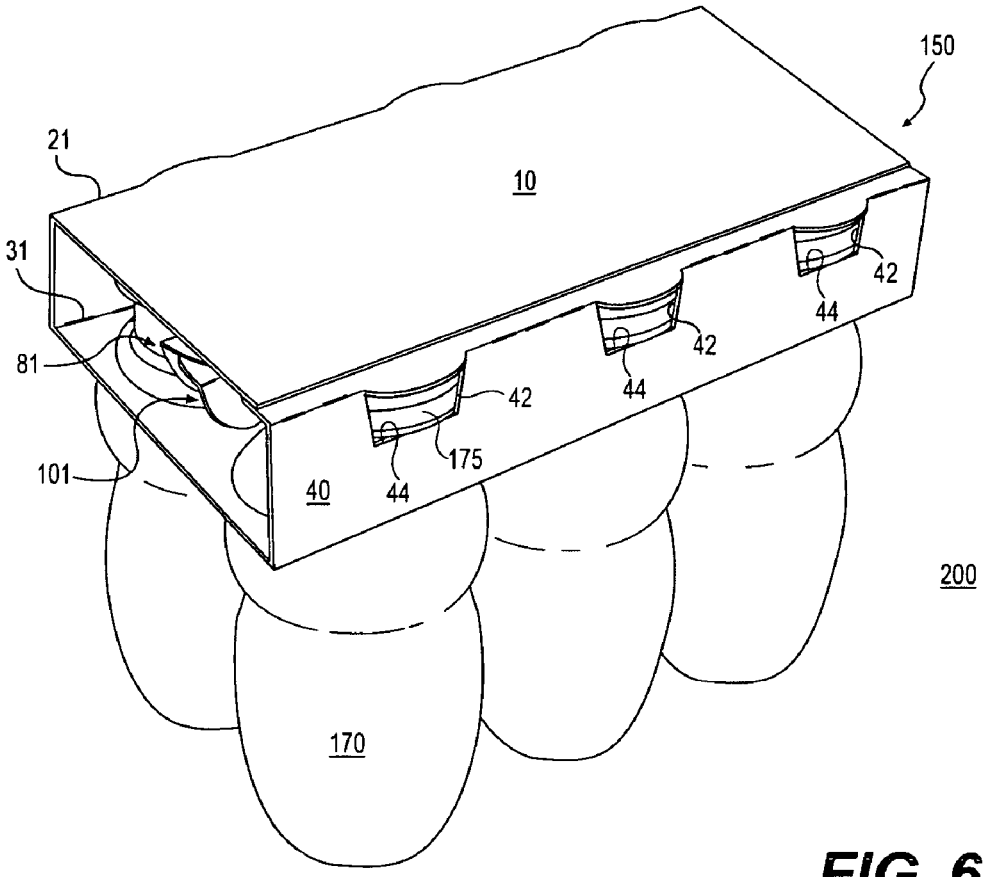
FIG. 6 illustrates the first package embodiment.

Referring to FIG. 6, the carton 150 secures upper portions of the containers 170 to form the package 200. When closing the carton 150, the top panel 50 and the adhesive panel 10 can be brought together and joined relatively tightly so that the flanges 175 of the containers 170 extend through and are supported by the brace apertures 22, 42 in the side panels 20, 40. Undersides of the container flanges 175 are thereby securely engaged with the brace edges 24, 44. The engaged adjacent upper and lower strut pairs 81, 101 support the undersides of the flanges 175 within the carton 150.

According to the above embodiment, containers 170 are securely retained by the brace apertures 22, 42 in the side panels and by the engaged strut pairs 81, 101 in the carton interior. The containers 170 are thereby secured against being pulled downwardly through the bottom panel 30, and are also secured against excessive movement or pivoting within the carton 150.

The exemplary embodiment shown in FIG. 6 illustrates a carton 150 accommodating six containers 170 arranged in two rows and three columns. Additional columns, for example, may be added by increasing the width of the blank 8 (in the transverse direction in FIG. 1) and forming additional opposed container-receiving patterns 80, 100 in the bottom panel 30 and corresponding aligned brace apertures 22, 42 in the side panels.

The exemplary package embodiment shown in FIG. 6 includes a top panel 10 that extends across the entire width of the package and is adhered to the adhesive panel 50 to close the package. The "top panel" of the package could alternatively comprise, for example, a first top panel foldably connected to the first side panel, and a second top panel foldably connected to the second side panel. The two top panels can wholly or partially overlap and can be joined by adhesives, for example, mechanical means, or by other means.

In this specification, the term "flange" indicates any radially projecting rim, collar, ring, raised portion or protrusion extending from an upper portion of a container.

The blank 8 according to the present invention can be, for example, formed from coated paperboard and similar materials. The blank can also be constructed of other materials, such as cardboard, hard paper, or any other material having properties suitable for enabling the resultant package to function at least generally as described in this specification.

The interior and/or exterior sides of the blank 8 can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank, or laminated to or coated with one or more sheet-like materials at selected panels or panel sections.

In accordance with the exemplary embodiment of the present invention, a fold line can be any substantially linear, although not necessarily straight, form of disruption or weakening in the blank 8 that facilitates folding therealong. More specifically, but not for the purpose of narrowing the scope of the present invention, fold lines include: score lines; crease lines; a cut or a series of cuts that extend partially into and/or completely through the material along the desired line of weakness; and various combinations of these features.

The above embodiments may be described as having one or panels adhered together by glue. The term "glue" is intended to encompass all manner of adhesives commonly used to secure carton panels in place.

The description is not intended to limit the invention to the form disclosed herein. Also, it is intended that the appended claims be construed to include alternative embodiments, not explicitly defined in the detailed description.

What is claimed is:

1. A package, comprising:

a carton, comprising:

a top panel;

a bottom panel;

a first side panel;

a second side panel;

a plurality of upper struts extending from the bottom panel along a first row, each upper strut comprising an upper strut first section and an upper strut second section, the upper strut second sections being foldably connected to the bottom panel and extending generally upward from the bottom panel, the upper strut first sections each being folded relative to a respective upper strut second section;

a plurality of lower struts extending from the bottom panel along a second row adjacent to the first row of upper struts, wherein each lower strut comprises a lower strut first section and a lower strut second section foldably connected to the lower strut first section, the lower strut second sections being foldably connected to the bottom panel and extending generally upward from the bottom panel, the lower strut first sections each being folded relative to a respective lower strut second section;

a first row of container apertures, each container aperture in the first row of container apertures being adjacent to one of the plurality of upper struts; and a second row of container apertures, each container aperture in the second row of container apertures being adjacent to one of the plurality of lower struts; and a plurality of containers, each container being accommodated in one of the container apertures and having a flange with an underside, wherein each upper strut first section contacts the underside of a flange of a container accommodated in the first row of container apertures and the underside of the flange of an adjacent container accommodated in the second row of container apertures, and each upper strut comprises a receiving aperture and each lower strut first section comprises a projection extending through one of the receiving apertures, wherein each of the receiving apertures is at least partially defined by one of the upper strut second sections.

2. The package of claim 1, wherein:

each lower strut first section is out of contact with the flanges; and each lower strut second section is out of contact with the flanges.

3. The package of claim 1, wherein the first and second rows of container apertures are arranged in a plurality of columns.

4. The package of claim 3, wherein the plurality of columns comprises at least three columns.

5. The package of claim 1, wherein each upper strut's first section is connected to its second section at a fold line.

6. The package of claim 5, wherein each lower strut's first section is connected to its second section at a fold line.

7. The package of claim 1, further comprising:

a plurality of first brace apertures in the first side wall; and a plurality of second brace apertures in the second side wall, wherein each container is supported by at least one of the brace apertures at the underside of its flange.

8. The package of claim 1, wherein each upper strut first section has a concave curved distal edge.

9. The package of claim 1, wherein the upper strut first sections are substantially parallel to the bottom panel.

10. The package of claim 1, wherein the carton has a substantially tubular shape with open ends.

11. The package of claim 1, further comprising an adhesive panel foldably connected to the second side panel and adhered to the top panel.

12. The package of claim 1, wherein tops of at least some of the containers abut the top panel.

13. The package of claim 1, wherein portions of the container apertures are curved.

14. A blank comprising:

a top panel;

a first side panel;

a bottom panel;

a second side panel;

a plurality of first container-receiving patterns in the bottom panel, each first container-receiving pattern defining an upper strut first section, an upper strut second section foldably connected to the upper strut first section and the bottom panel, and a first container aperture, the upper strut first section being foldably connected to the upper strut second section at a fold line for independently foldably positioning the upper strut first section relative to the upper strut second section; and a plurality of second container-receiving patterns in the bottom panel, each second container-receiving pattern defining a first lower strut first section, a lower strut second section foldably connected to the lower strut first section and the bottom panel, and a second container aperture, the lower strut first section being foldably connected to the lower strut second section at a fold line for independently foldably positioning the lower strut first section relative to the lower strut second section, wherein the first container-receiving patterns are arranged in a first row and the second container-receiving patterns are arranged in a second row, and each upper strut second section at least partially defines a receiving aperture and each lower strut first section comprises a projection extending from a distal edge of the lower strut first section, each receiving aperture being sized to receive one of the projections and each projection extending through one of the receiving apertures when the blank is erected into a carton.

15. The blank of claim 14, wherein:

the first and second container-receiving patterns are each arranged in at least two columns, each column of second container-receiving patterns being aligned with a column of the first container-receiving patterns.

16. The blank of claim 14, further comprising an adhesive panel foldably connected to the second side panel.

17. The blank of claim 16, wherein:

the top panel is foldably connected to the first side panel;

the first side panel is foldably connected to the bottom panel; and the bottom panel is foldably connected to the second side panel.

18. The blank of claim 14, wherein the blank is constructed from paperboard.

19. The blank of claim 15 wherein the first side panel has a plurality of first brace apertures and the second side panel has a plurality of second brace apertures, the first brace apertures are arranged in at least two columns, each column of first brace apertures being aligned with a column of first container-receiving patterns.

20. The blank of claim 19 wherein:

the second brace apertures are arranged in at least two columns, each column of second brace apertures being aligned with a column of first container-receiving patterns.

21. The blank of claim 14 wherein the blank is for forming a package for holding a plurality of containers having a flange with an underside, wherein each upper strut first section is for contact with an underside of a flange of a container accommodated in the first container aperture and the underside of a flange of an adjacent container accommodated in the second container aperture.

22. The package of claim 1, wherein each of the upper strut first sections extends substantially parallel to the bottom panel and each of the lower strut first sections extends substantially parallel to the bottom panel, each of the upper strut first sections being in face-to-face contact with a respective one of the lower strut first sections.

* * * * *